US006190125B1

(12) United States Patent
Hayashi et al.

(10) Patent No.: US 6,190,125 B1
(45) Date of Patent: Feb. 20, 2001

(54) SUCTION FLOW PRESWIRL CONTROL BYPASS STRUCTURE FOR BLOWERS

(75) Inventors: Shiro Hayashi; Naotaka Kuramoto, both of Mie (JP)

(73) Assignee: Showa Furyoko Kikai Kabushiki Kaisha, Osaka (JP)

( * ) Notice: Under 35 U.S.C. 154(b), the term of this patent shall be extended for 0 days.

(21) Appl. No.: 09/331,298

(22) PCT Filed: Oct. 22, 1998

(86) PCT No.: PCT/JP98/04802

§ 371 Date: Jun. 18, 1999

§ 102(e) Date: Jun. 18, 1999

(87) PCT Pub. No.: WO99/22146

PCT Pub. Date: May 6, 1999

(30) Foreign Application Priority Data

Oct. 24, 1997 (JP) ..... 9-309684

(51) Int. Cl.[7] ..... F01D 1/02
(52) U.S. Cl. ..... 415/206; 415/182.1
(58) Field of Search ..... 415/2.1, 4.5, 182.1, 415/183, 203, 206, 221, 222, 224, 226, 227

(56) References Cited

U.S. PATENT DOCUMENTS 1,073,824 * 9/1913 Smith ..... 415/183
4,320,304 * 3/1982 Karlsson et al. ..... 415/222 X
4,932,837 * 6/1990 Rymal ..... 415/206
5,100,289 * 3/1992 Caoduro ..... 415/206 X

FOREIGN PATENT DOCUMENTS 61-178100 6/1986 (JP) .
2-105598 8/1990 (JP) .
5-340395 12/1993 (JP) .
6-10894 1/1994 (JP) .

* cited by examiner

*Primary Examiner*—John E. Ryznic
(74) *Attorney, Agent, or Firm*—William J. Sapone; Coleman, Sudol, Sapone, P.C.

(57) ABSTRACT

The objects of the present invention are to improve the fan efficiency by the decrease of the shaft power of a fan and/or the increase of the pressure rise owing to a fan impeller, which are accomplished by the rational control of the energy based on the tangential velocity of the prerotation flow generating at 'the region ahead of an impeller' inside the suction pipe of a fan, and to reduce fan noise by the improvement of air flow at the portion in close vicinity to an impeller inside the suction pipe. The present invention is related to a by-pass unit (5) disposed upstream an impeller to control the energy generated by the air flowing into the impeller (1), comprising a specific region of a suction pipe (2) as a part of the by-pass unit (5), an air chamber (3), through which the air is able to pass, forming a closed spatial region outside the suction pipe (2), and communicating passages (4) for connecting the closed spatial region to the suction pipe (2).

11 Claims, 10 Drawing Sheets

SUCTION FLOW PRESWIRL CONTROL BYPASS STRUCTURE FOR BLOWERS

TECHNICAL FIELD OF THE INVENTION

The present invention relates to a by-pass unit for controlling the prerotation of flow in a suction pipe, in more particular, a unit for controlling the prerotation of the air flowing into an impeller of a fan, e.g., of the centrifugal flow type, the axial flow type and the mixed flow type, in order to increase fan efficiency and to reduce fan noise.

PRIOR ART

Various technical ideas have been made to suppress the prerotation of the air flowing into an impeller of a pump and/or a fan. For instance, 'Designing and Drawing for Centrifugal Flow Pump' authored by Susumu TERADA, Jun. 15, 1972, 4th edition, (published by Riko Tosho Co. Ltd.,), page 36 and pages 66 to 71, 'Centrifugal and Axial Flow Fan and Compressor' authored by Takebumi IKUI, Jul. 30, 1964, 5th edition, (published by Asakura Shoten Co. Ltd.,), pages 222 to 225, and 'Turbo Fan and Compressor' authored by Takebumi IKUI and Masahiro INOUE, Aug. 25, 1988, (published by Corona Co. Ltd.,) teach that a flat or cylindrical baffle plate disposed at 'the region ahead of an impeller' inside a suction pipe contributes to suppress the prerotation of the suction air flowing into an impeller and that a tapered suction pipe decreases the unfavorable influence based on the prerotation of flow.

A general theory of the generation mechanism of the prerotation of flow is explained as follows: Reverse flow (spiral vortex) induced at 'the region ahead of an impeller' inside a suction pipe of a pump and/or a fan with any cause results in generating the prerotation of flow. According to such a prior theory the ideas mentioned above do not provide a concrete structure for rationally controlling the energy based on the tangential velocity of prerotation flow.

According to the '2nd Edition Centrifugal and Axial Flow Pumps' authored by A. J. STEPANOFF, 1957, (published by John Wiley & Sons, Inc.,), pages 38 to 42, and in the 'Pump and Blower' authored by A. J. STEPANOFF, translated by Kensaku IMAICHI et al., Nov. 12, 1979, 1st edition, (published by Sangyo Tosho Co. Ltd.,), pages 78 to 101, the mechanism of prerotation of the air flowing into an impeller is explained as follows:

At 'the region ahead of an impeller' inside a suction pipe of a pump or a fan the prerotation is generated according to the principle of the least resistance. The rotational direction of prerotation is not always identical to that of a fan impeller because the prerotation is not generated by the fact that the impeller blades directly transmit the force to the air. The prerotation has the tangential velocity with the direction identical to that of the rotation of an impeller under the operation at a capacity smaller than the design normal capacity, on the other hand, it has the tangential velocity with the direction opposite to that of the rotation of an impeller under the operation at a capacity greater than the design normal capacity. It should be noted that the reverse flow (spiral vortex) at 'the region ahead of an impeller' inside a suction pipe generates in consequence of the prerotation because the prerotation is not induced by the reverse flow.

The first object of the present invention is to provide a by-pass unit for controlling the prerotation of flow in the suction pipe of a fan, improving the fan efficiency by the decrease of the shaft power of a fan and/or the increase of the pressure rise (head) based on the impeller of a fan, which are accomplished by rationally controlling the energy based on the tangential velocity of the prerotation flow generating at 'the region ahead of an impeller' inside a suction pipe of a fan according to the STEPANOFF's theory described above. And the second object is to improve the air flow inside a suction pipe at the region in close vicinity to an impeller, thereby, reducing the fan noise.

THE PRESENT INVENTION

The present invention is applied to the inlet of a fan equipping the suction pipe for introducing suction air into a fan impeller. Referring to FIG. 1, it is characterized by that an air chamber 3 forming a closed spatial region is disposed at the outside of 'the region ahead of an impeller' of a suction pipe 2 and more than three communicating passages 4 for connecting between the air chamber 3 and the suction pipe 2 is provided along the flowing direction of suction air, enabling to transmit air pressure from the suction pipe 2 to the air chamber 3 and vice versa and to introduce air thereinto through the communicating passages 4, and forming by-pass routes of the suction pipe 2 by the air chamber 3 and the communicating passages 4, thereby, generating by-pass flow 5*a* (see FIG. 8) in a part of the suction air.

As shown in FIG. 2, the air chamber 3 is a box 3A equipped outside the suction pipe 2, and the communicating passages 4 are tubes 4A connecting the suction pipe 2 to the box 3A. For example, as shown in FIG. 13, in the case that a cylindrical closed chamber 3B is formed on the periphery of 'the region ahead of an impeller' of the suction pipe 2, the holes 4B punched on the peripheral wall 2*m* of the suction pipe 2, which partitions off the cylindrical closed chamber 3B and the suction pipe 2, are usable as the communicating passages 4.

Referring to FIG. 3, 'the region ahead of an impeller' of the suction pipe 2 comprises n cylindrical portions $\mathbf{2}_1$, $\mathbf{2}_2$, . . . , $\mathbf{2}_{n-1}$ and $\mathbf{2}_n$ having different inner diameters along the flowing direction of suction air and truncated cone portions $\mathbf{2}a_1$, $\mathbf{2}a_2$, . . . , $\mathbf{2}a_{n-2}$ and $\mathbf{2}a_{n-1}$ for connecting the cylindrical portions, where a maximum inner diameter is given by $d_{MAX}$ and a minimum is by $d_{MIN}$, and the axial length of truncated cone portions are $B_i$ (when i=1, 2, 3, . . . and n−1), in the case of a centrifugal flow fan 11 (see FIG. 4(*a*)) not providing a side plate on the side of a suction pipe along the impeller axis 1*a* of the blades $\mathbf{1}A_1$, a point $Z_{Pa}$ on the impeller axis corresponding to the entrance end $p_{a1}$ of blades is chosen as a reference point when the entrance end $p_{a1}$ of blades on the side edge located at the side of a suction pipe of the impeller blades $\mathbf{1}A_1$ is closer to the suction pipe than the discharge end $p_{a2}$ thereof along the impeller axis 1*a*, the length from the reference point $Z_{Pa}$ to the upstream point of the by-pass unit 5 for controlling the prerotation of flow is defined by $Z_1$, and the length from the reference point $Z_{Pa}$ to the downstream point thereof is by $Z_2$, the present invention is characterized by that the positional relation between the by-pass unit 5 for controlling the prerotation of flow and the impeller 1 should fulfil following equations;

$$Z_1 \leqq 2 \cdot d_{MAX} + \Sigma B_i \text{ and}$$

$$0.03 \cdot d_{MIN} \leqq Z_2 < Z_1,$$

besides, in the case of $d_{MAX}$>100 mm and $d_{MIN}$>100 mm $$0.4 \cdot d_{MIN} < Z_1 - Z_2,$$

and in the case of $d_{MAX} \leqq 100$ mm and/or in the case of $d_{MAX}$>100 mm and $d_{MIN} \leqq 100$ mm $$40 \text{ mm} < Z_1 - Z_2.$$

As shown in FIG. 4(*b*), in the case that a side plate is not provided on the side of suction pipe along the impeller axis 1*a* of the blades $\mathbf{1}A_1$ of a centrifugal flow fan 11 and the discharge end $p_{b2}$ of blades on the side edge located at the side of a suction pipe of the blades $\mathbf{1}A_1$ is closer to the suction pipe than the entrance end $p_{b1}$ thereof along the impeller axis 1*a*, the above-mentioned reference point is assigned to the point $Z_{Pb}$ on the impeller axis corresponding to the discharge end $p_{b2}$ of blades. On the other hand, as shown in FIG. 4(*c*), in the case that a side plate $\mathbf{1}_p$ is fixed to the blades $\mathbf{1}A_1$ of the centrifugal flow fan 11 on the side of suction pipe, a main plate $\mathbf{1}_q$ is fixed to the blades on the counter side of suction pipe, and a mouth ring Im is attached to the side plate, the reference point is assigned to the point $Z_{Pc}$ on the impeller axis 1*a* corresponding to the most upstream point of the mouth ring 1*m*.

The case of an axial flow fan is as follows: As shown in FIG. 5(*a*), the reference point mentioned above is assigned to the point $Z_{Pd}$ on the impeller axis corresponding to the root $p_{d1}$ on the upstream edge 1*c* of the blades $\mathbf{1}A_2$ of an axial flow fan 12 in the case that the root $p_{d1}$ of the blades is closer to the suction pipe than the tip $p_{d2}$ thereof along the impeller axis 1*a*, and as shown in FIG. 5(*b*), it is assigned to the point $Z_{Pe}$ on the impeller axis corresponding to the tip $p_{e2}$ in the case that the tip $p_{e2}$ is closer to the suction pipe than the root $p_{e1}$ along the impeller axis 1*a*.

The case of a mixed flow fan is as follows: As shown in FIG. 6(*a*), in the case that a side plate is not provided at the tip of impeller blades $\mathbf{1}A_3$ of the mixed flow fan 13 and the tip $p_{f2}$ on the upstream edge 1*d* of blades is closer to the suction pipe than the root $p_{f1}$ thereof along the impeller axis 1*a*, the reference point is assigned to the point $Z_{Pf}$ on the impeller axis corresponding to the tip $p_{f2}$. And as shown in FIG. 6(*b*), in the case that the root $p_{g1}$ is closer to the suction pipe than the tip $p_{g2}$ along the impeller axis 1*a*, the reference point is assigned to the point $Z_{Pg}$ on the impeller axis corresponding to the root $p_{g1}$. Besides, as shown in FIG. 6(*c*), in the case that a mouth ring 1*n* is attached the side plate 1*r* which is fixed to the edge of the impeller blades $\mathbf{1}A_3$, the reference point is assigned to the point $Z_{Ph}$ on the impeller axis 1*a* corresponding to the most upstream point of the mouth ring 1*n*.

According to the present invention, the by-pass routes are formed by an air chamber and communicating passages so that the air pressure can be transmitted between the suction pipe and the air chamber through the communicating passages and the air can be also introduced thereinto, resulting in generation of the by-pass flow in a part of the suction air.

Consequently, the energy based on the tangential velocity of the prerotation flow generating at 'the region ahead of an impeller' inside the suction pipe of a fan can be rationally controlled, accordingly, the fan efficiency can be improved by the decrease of the shaft power of a fan and/or the increase of the pressure rise owing to a fan impeller. Besides, the fan noise can be reduced by the improvement of air flow at the portion in close vicinity to an impeller inside the suction pipe.

In the case that an air chamber is a box disposed outside a suction pipe and communicating passages are tubes connecting the box to the suction pipe they will be also installed on the fans already made. Not only the fan efficiency of the fan can be improved but the fan noise thereof can be reduced. Of course, also in the case that a cylindrical closed chamber formed on the periphery of 'the region ahead of an impeller' of the suction pipe is used as an air chamber and the holes punched on the peripheral wall of a suction pipe, partitioning off the cylindrical closed chamber and the suction pipe, are adopted as communicating passages, the fan displaying the above-mentioned effect can be made compact.

Regulating the length from the specified reference point to the upstream point of a by-pass unit for controlling the prerotation of flow and the length from the above-mentioned reference point to the downstream point thereof as described in claim 4 promotes the effect of the present invention, and provides the useful indexes for designing a fan.

In the case that the present invention is applied to the blade with different figure and/or the fan of different type, the choice according to Claims 5 to 11 will definitely give the reference point of fans, respectively, enabling to supply sufficient information for designing various kinds of fan.

PREFERABLE EMBODIMENT

Figure 2:
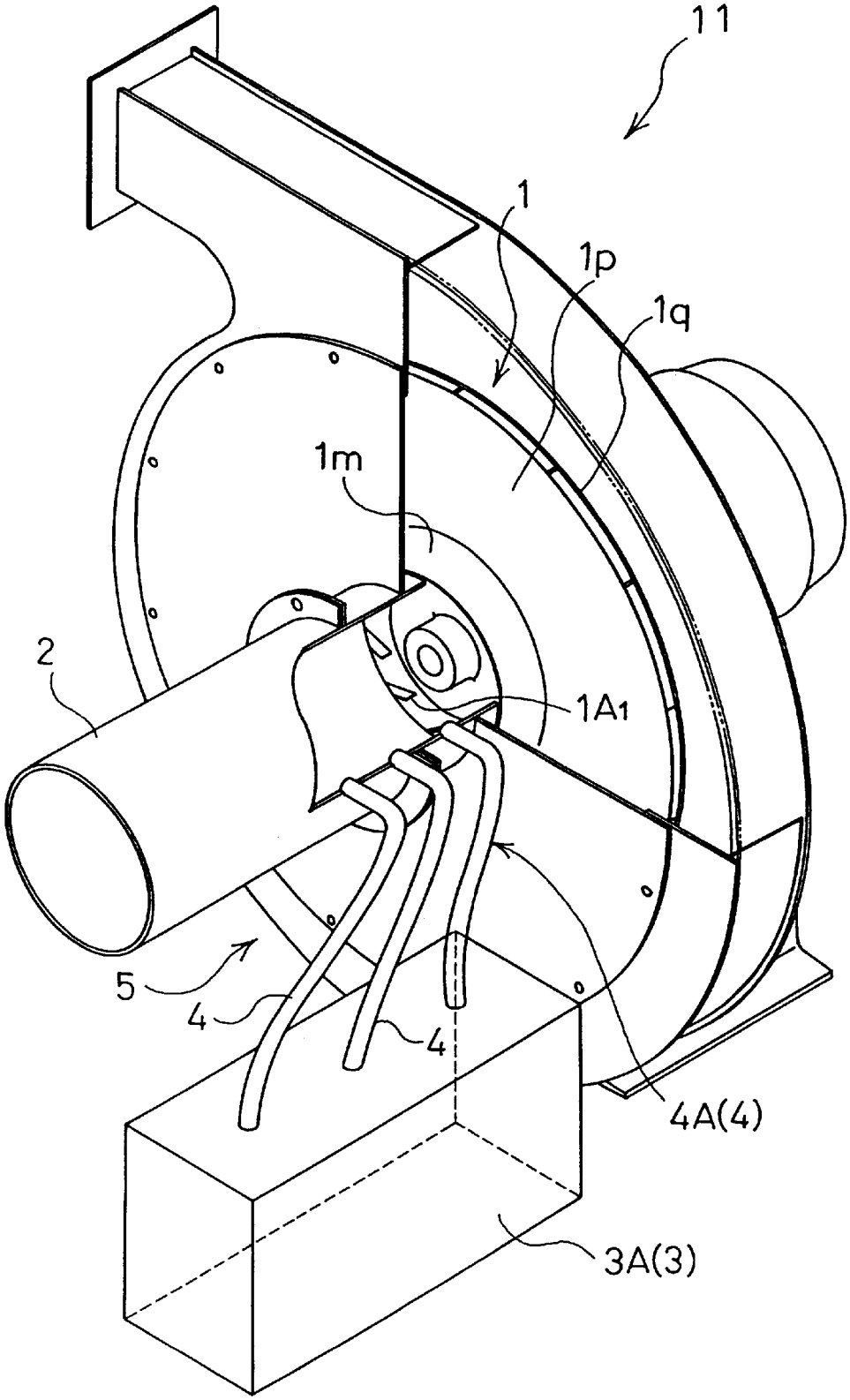
FIG. 2 is a schematic view of one of a centrifugal flow fan as an example E to which a by-pass unit for controlling the prerotation of flow of a fan concretely applied.

A by-pass unit for controlling the prerotation of flow in the suction pipe of a fan according to the present invention is disclosed by referring to some drawings indicating favorable embodiments of the invention. FIG. 2 shows a schematic drawing of a centrifugal flow fan 11, to which a by-pass unit for controlling the prerotation of suction air according to the invention is applied at 'the region ahead of an impeller' of a suction pipe 2 for introducing suction air into an impeller 1.

An air chamber 3 forming a closed spatial region is equipped outside 'the region ahead of an impeller' of the suction pipe 2, which is connected with the suction pipe 2 by means of plural communicating passages 4 arranged along the flowing direction of suction air. At least three communicating passages are provided along the flowing direction of suction air as described later. In FIG. 2, the air chamber 3 forming a closed spatial region is a box 3A equipped outside the suction pipe 2. In this embodiment, the communicating passages 4 are tubes 4A connecting the box 3A to the suction pipe 2.

Such a mechanism gives a by-pass unit 5 for controlling the prerotation of flow, which generates by-pass flow in a part of suction air. Concretely, the communicating passage 4 transmits air pressure from suction pipe 2 to air chamber 3 and vice versa, and introduces air thereinto. Plural routes for by-passing the suction pipe 2 are formed by the combination of air chamber 3 and communicating passages 4 arranged along the flowing direction of suction air.

Figure 3:
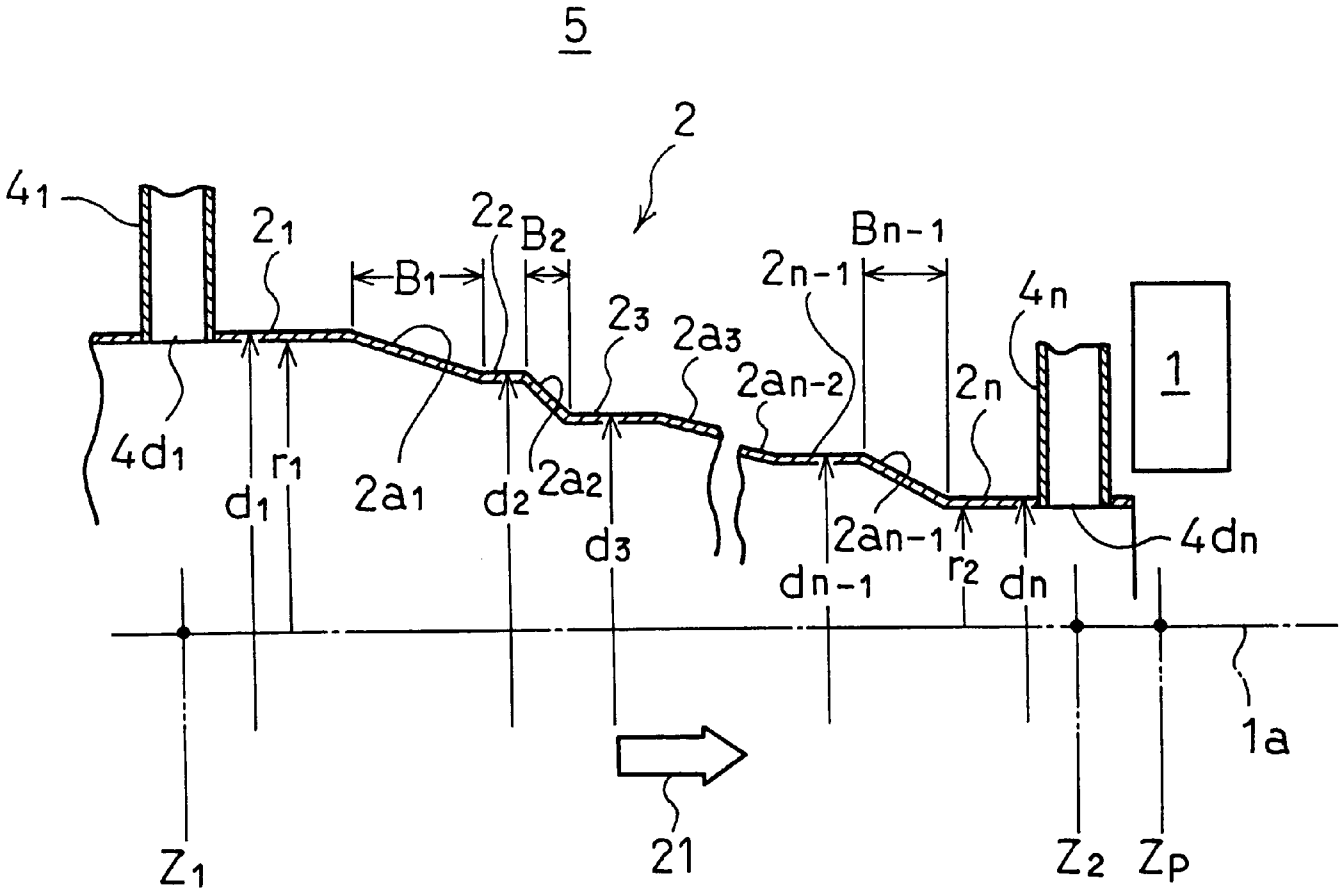
FIG. 3 is a model drawing for analyzing, in which the inner diameter of a suction pipe is generally indicated.

The relation of relative position between the by-pass unit 5 for controlling the prerotation of flow and the impeller 1 is given by symbols of $Z_1$ and $Z_2$, which are defined in the model of FIG. 3. A contoured arrow 21 in the drawing teaches the direction of the suction air flowing into the impeller 1.

A general example of 'the region ahead of an impeller' of suction pipe 2 is disclosed. It consists of n cylindrical portions $\mathbf{2}_1$, $\mathbf{2}_2$, . . . , $\mathbf{2}_{n-1}$ and $\mathbf{2}_n$ having different inner diameters along the flowing direction of suction air and truncated cone portions $\mathbf{2}a_1$, $\mathbf{2}a_2$, . . . , $\mathbf{2}a_{n-2}$ and $\mathbf{2}a_{n-1}$ for connecting cylindrical portions.

Providing that the inner diameters of cylindrical portions $\mathbf{2}_1$, $\mathbf{2}_2$, . . . and $\mathbf{2}_n$ are $d_1$, $d_2$, . . . and $d_n$, where a maximum inner diameter is given $d_{MAX}$ and a minimum is $d_{MIN}$, that the axial length of truncated cone portions $\mathbf{2}a_1$, $\mathbf{2}a_2$, . . . and $\mathbf{2}a_{n-1}$ are $B_i$ (when i=1, 2, 3, . . . and n−1), that the length from reference point $Z_P$ described later to the upstream point of by-pass unit 5 for controlling the prerotation is $Z_1$, and that the length from reference point $Z_P$ to the downstream point of by-pass unit 5 is $Z_2$, the positional relation between the by-pass unit 5 and the impeller 1 is preferable to fulfil following equations.

$$Z_1 \leqq 2 \cdot d_{MAX} + \Sigma B_i \quad \text{(a)}$$

$$0.03 \cdot d_{MIN} \leqq Z_2 < Z_1 \quad \text{(b)}$$

The upstream point of by-pass unit 5 corresponds to the center of opening $\mathbf{4}d_1$ of the communicating passage $\mathbf{4}_1$ equipped on cylindrical portion $\mathbf{2}_1$, and the downstream point of by-pass unit 5 corresponds to the center of opening $\mathbf{4}d_n$ of the communicating passage $\mathbf{4}_n$ equipped on cylindrical portion $\mathbf{2}_n$. A reference point $Z_P$ of a fan indicates the position of blade end on the side of a suction pipe along the impeller axis 1*a*, which means a position of the most upstream end of a mouth ring along the impeller axis 1*a* in the case that a mouth ring is fixed to the side plate of an impeller. Physically, it means the position where the air flowing into the impeller begins to be directly pressurized by impeller blades. Such a reference point $Z_P$ is described in detail later because it is different every kind of fan.

In equation (a) mentioned above, $Z_1$ is chosen less than or equal to $2 \cdot d_{MAX} + \Sigma B_i$ because the prerotation of flow mentioned in the present invention hardly generates in the case that $Z_1$ is larger than $2 \cdot d_{MAX} + \Sigma B_i$. Of course, the inventors have already confirmed that the invention was ineffective under the condition which is larger than $2 \cdot d_{MAX} + \Sigma B_i$.

In addition, in equation (b), the lower limit of $Z_2$ is $0.03 \cdot d_{MIN}$ because the distance between the most proximate portion of impeller 1 to the suction pipe and the effective region for by-passing has to be as short as possible in order to decrease the angular velocity of the prerotation of the air flowing into the impeller. On the other hand, if it is smaller than $Z_1$, the inventors have also confirmed that it may take a large value as long as it satisfies the equations (c) and (d) mentioned after. Contrarily, if $Z_2$ is smaller than $0.03 \cdot d_{MIN}$, $Z_2$ will extremely come close to the reference point $Z_P$, as the result, it will be located at the opposite side of suction pipe crossing $Z_3$ where is the critical position that the air flowing into the after-mentioned impeller is not pressurized by the impeller blades.

As above-mentioned, the following conditions are indispensable to the present invention. Many experiments performed by the inventors have proved that it was important for the positional relation between the by-pass unit and the impeller to fulfil following equations. In the case of $d_{MAX} > 100$ mm and $d_{MIN} > 100$ mm $$0.4 \cdot d_{MIN} < Z_1 - Z_2 \quad \text{(c)},$$

and in the case of $d_{MAX} \leqq 100$ mm and/or in the case of $d_{MAX} > 100$ mm and $d_{MIN} \leqq 100$ mm $$40 \text{ mm} < Z_1 - Z_2 \quad \text{(d)}.$$

These conditions are subject to the intention for realizing a by-pass unit with a proper region and generating by-pass air flow.

The above-mentioned indicates a general example that the suction pipe 2 has various inner diameters. In a case that 'the region ahead of an impeller' of a suction pipe is a cylinder with constant inner diameter $d_0$ (see FIG. 1) along the flowing direction of suction air, it will be $d_{MAX}=d_{MIN}=d_0$ and $B_i=0$, therefore, the above-mentioned equations (a) and (b) are simply formulated as follows;

$$Z_1 \leqq 2 \cdot d_0 \quad \text{(a') and}$$

$$0.03 \cdot d_0 \leqq Z_2 < Z_1 \quad \text{(b').}$$

And following conditions are added to the positional relation between the by-pass unit 5 for controlling the prerotation of flow and the impeller 1. In the case of $d_0>100$ mm $$0.4 \cdot d_0 < Z_1 - Z_2 \quad \text{(c'),}$$

and in the case of $d_0 \leqq 100$ mm $$40 \text{ mm} < Z_1 - Z_2 \quad \text{(d').}$$

The following are examples that concrete values are applied to equations (a'), (b') and (c') mentioned above.

(i) In the case of a suction pipe of $d_0=200$ mm, $Z_1 \leqq 400$, $6.0 \leqq Z_2$ and $80 < Z_1 - Z_2$.

(ii) In the case of a suction pipe of $d_0=150$ mm, $Z_1 \leqq 300$, $4.5 \leqq Z_2$ and $60 < Z_1 - Z_2$.

If appropriate values of $Z_1$ and $Z_2$ satisfying the above-mentioned equations are chosen, a combination indicated in (A) of Table 1 is given in the case of (i) and a combination indicated in (B) of Table 1 is given in the case of (ii). (unit in millimeter)

TABLE 1

| $d_0$ | $Z_1$ | $Z_2$ | $Z_1-Z_2$ |
|---|---|---|---|
| | | (A) | |
| 200 | 400 | 319 | 81 |
| | | 200 | 200 |
| | | 150 | 250 |
| | | 100 | 300 |
| | | 50 | 350 |
| | | 6 | 394 |
| | 300 | 219 | 81 |
| | | 100 | 200 |
| | | 50 | 250 |
| | | 6 | 294 |
| | 200 | 119 | 81 |
| | | 50 | 150 |
| | | 6 | 194 |
| | 100 | 19 | 81 |
| | | 6 | 94 |
| | | (B) | |
| 150 | 300 | 239 | 61 |
| | | 200 | 100 |
| | | 150 | 150 |
| | | 100 | 200 |
| | | 50 | 250 |
| | | 5 | 295 |
| | 200 | 139 | 61 |
| | | 100 | 100 |

TABLE 1-continued

| $d_0$ | $Z_1$ | $Z_2$ | $Z_1-Z_2$ |
|---|---|---|---|
| | | 50 | 150 |
| | | 5 | 195 |
| | 100 | 39 | 61 |
| | | 5 | 95 |

The following are also examples that concrete values are applied to equations (a'), (b') and (c') mentioned above.

(iii) In the case of a suction pipe of $d_0=100$ mm, $Z_1 \leqq 200$, $3.0 \leqq Z_2$ and $40 < Z_1 - Z_2$.

(iv) In the case of a suction pipe of $d_0=50$ mm, $Z_1 \leqq 100$, $1.5 \leqq Z_2$ and $40 < Z_1 - Z_2$.

If appropriate values of $Z_1$ and $Z_2$ satisfying the above-mentioned equations are chosen, a combination indicated in (A) of Table 2 is given in the case of (iii) and a combination indicated in (B) of Table 2 is given in the case of (iv). (unit in millimeter)

TABLE 2

| $d_0$ | $Z_1$ | $Z_2$ | $Z_1-Z_2$ |
|---|---|---|---|
| | | (A) | |
| 100 | 200 | 159 | 41 |
| | | 100 | 100 |
| | | 50 | 150 |
| | | 3 | 197 |
| | 100 | 59 | 41 |
| | | 30 | 70 |
| | | 3 | 97 |
| | 50 | 9 | 41 |
| | | 3 | 47 |
| | | (B) | |
| 50 | 100 | 59 | 41 |
| | | 30 | 70 |
| | | 2 | 98 |
| | 50 | 9 | 41 |
| | | 2 | 48 |

Figure 4:
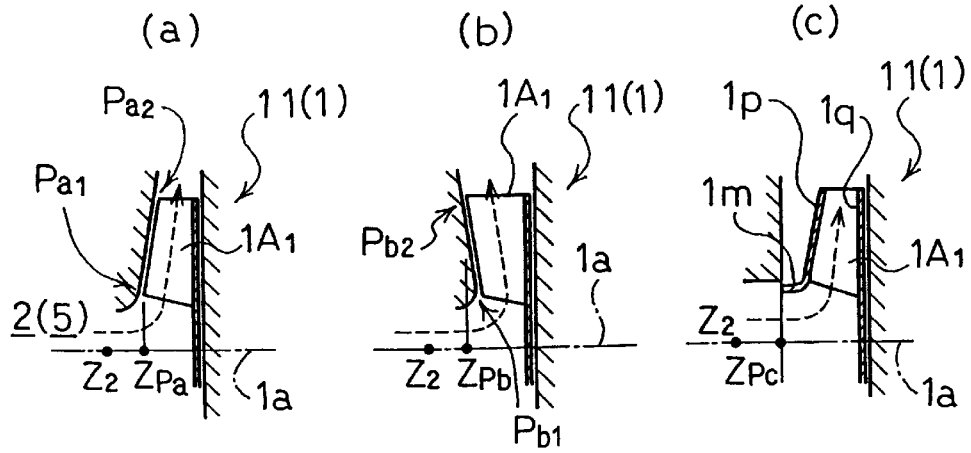
FIG. 4 is a drawing showing the reference points of centrifugal flow fan, (a) is a model drawing which the entrance end of blades on the side edge located at the side of a suction pipe of the blades is closer to the suction pipe than the discharge end thereof along the impeller axis in the case that neither a side plate nor a mouth ring is provided with the blades on the side of a suction pipe along the impeller axis of the blades, (b) is a model drawing which the discharge end is closer to the suction pipe than the entrance end along the impeller axis, and (c) is a model drawing in the case that a mouth ring is attached to the side plate which is fixed to the blades on the side of a suction pipe.

In the case of a centrifugal fan shown in FIG. 2, the most upstream point $Z_{Pc}$ of a mouth ring 1*m* along the impeller axis 1*a* is chosen as a reference point $Z_P$ mentioned above if a side plate 1*p* is fixed to the blades $\mathbf{1A_1}$ of centrifugal flow impeller on the side of suction pipe, a main plate 1*q* is fixed to the blades on the counter side of suction pipe, and a mouth ring 1*m* is attached to the side plate 1*p* as shown in FIG. 4(*c*).

A fan is provided with not only a rotating impeller 1 but a suction pipe 2 on the upstream side of the impeller. As far as there are such two means, the generation of prerotation of the air flowing into the fan impeller is unavoidable. Accordingly, it is necessary for the positional relation between the impeller 1 and the suction pipe 2 to be given by the formulated composition mentioned above in order to rationally control the energy based on the tangential velocity of the prerotation. The present invention is essentially composed of the combination of three means, i.e., an impeller 1, a suction pipe 2 and a unit for controlling the prerotation of flow.

Figure 1:
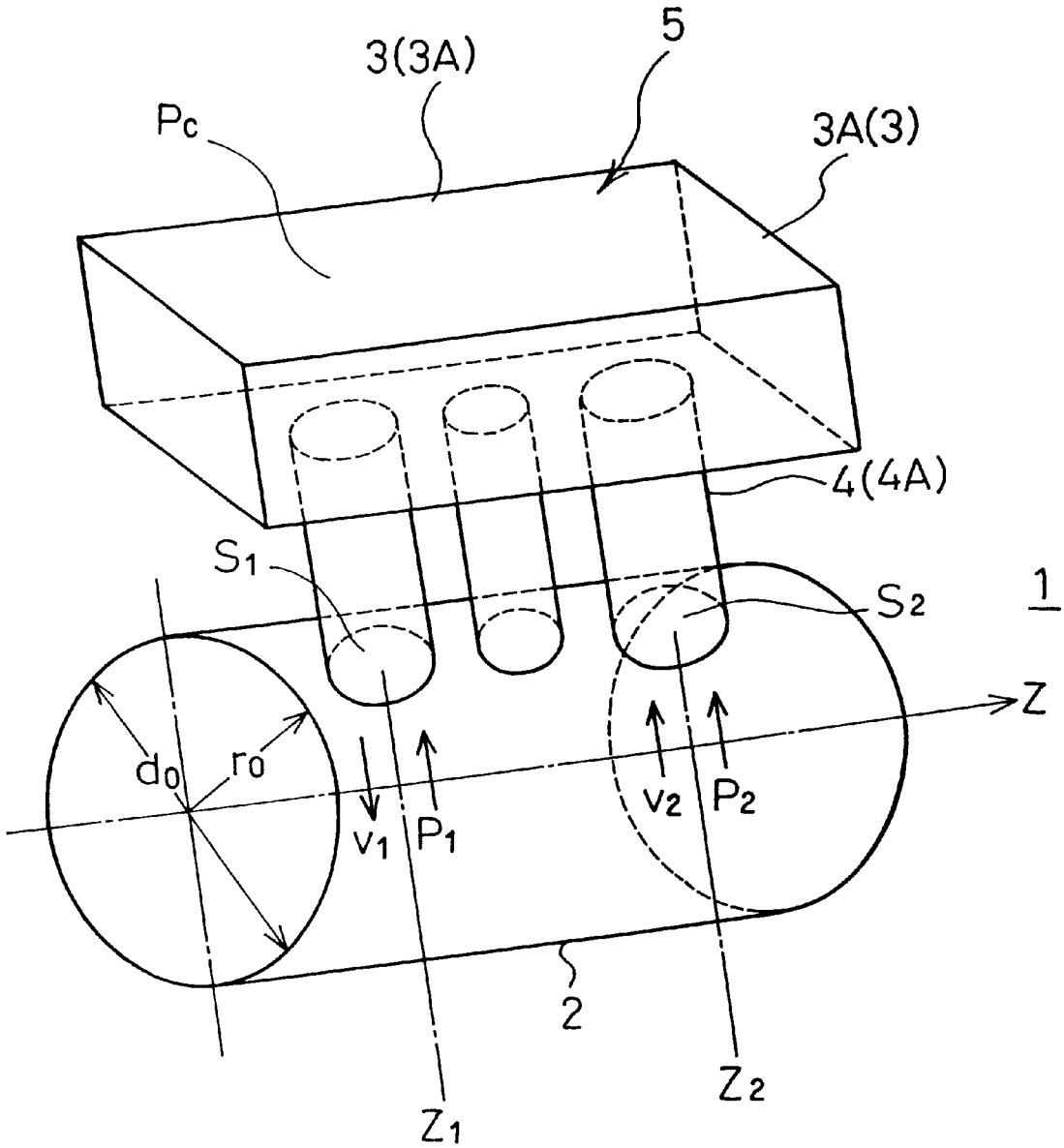
FIG. 1 is a model drawing for disclosing the mechanism of 'Function (a)' for transforming the energy based on the tangential velocity of prerotation flow inside a suction pipe into the effective work in the by-pass unit for controlling the prerotation of flow inside a suction pipe of a fan according to the present invention.

The system of the present invention is a by-pass unit for controlling the energy of the air flowing into the impeller 1, which is disposed upstream the impeller. The composition of the present by-pass unit includes a specific region of the suction pipe as a part thereof, and is provided with a closed spatial region enabling to pass the air outside the suction pipe 2. As shown in FIG. 1 described after, the closed spatial region as an air chamber 3 and the suction pipe 2 are connected by the communicating passages 4. Since more than three communicating passages 4 are provided along the flowing direction of the air in suction pipe 2, plural by-pass routes are established.

In the present unit it is preferable to consider following two matters: (1) The effective region for by-passing should be regulated by numerical limitation based on the diameter of a suction pipe at 'the region ahead of an impeller' and the axial length of truncated cone portions in order to express the relation of relative position to a fan impeller. (2) Plural by-pass routes of a suction pipe formed by the closed spatial region and communicating passages should be equipped. The reasons will be shown in after-mentioned [Function (a)]. Anyway, each communicating passage needs to have a route for transmitting air pressure from a suction pipe to an air chamber as a closed spatial region and vice versa, and for introducing air thereinto.

In order to comprehend the present invention the following matters should be considered: The first is to comprehend the mechanism for transforming the energy based on the tangential velocity of prerotation flow inside a suction pipe 2 into the effective work. The second is to comprehend the reason why the shaft power of a fan is reduced by the transformation of the energy based on the tangential velocity of prerotation flow into the effective work. The third is to comprehend the reason why the pressure rise (pressure head) based on the impeller of a fan is increased by the decrease of velocity component in the tangential direction of the prerotation flow. The last is to qualitatively explain the reason why fan noise can be decreased by the existence of the by-pass unit for controlling the prerotation of flow. The above-mentioned four matters are described in the following items of [Function (a)] to [Function (d)], respectively.

Figure 7:
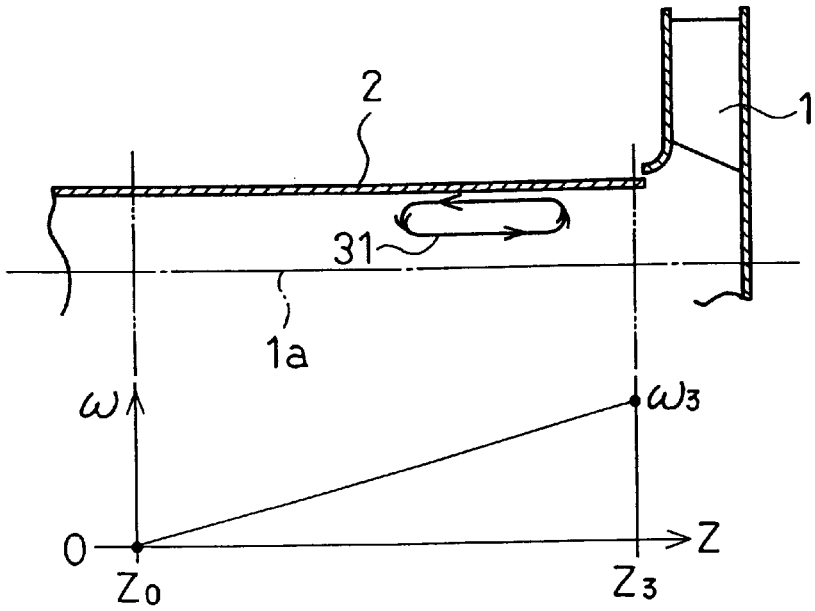
FIG. 7 is a model drawing without a by-pass unit for disclosing 'Function (a)' in the case that a ducting system is equipped on the inlet side of a fan.
Figure 8:
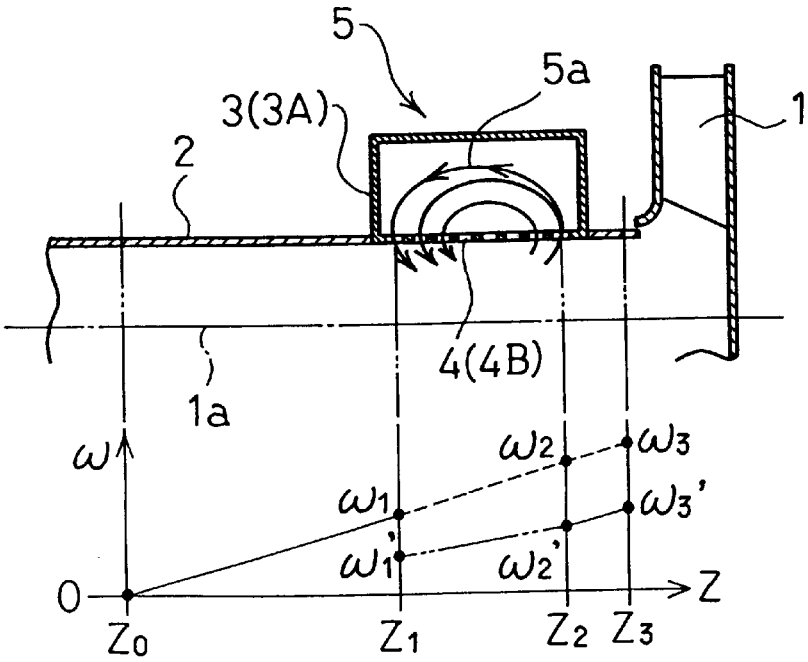
FIG. 8 is a model drawing with a by-pass unit for disclosing 'Function (a)' in the case that a ducting system is equipped on the inlet side of a fan.
Figure 9:
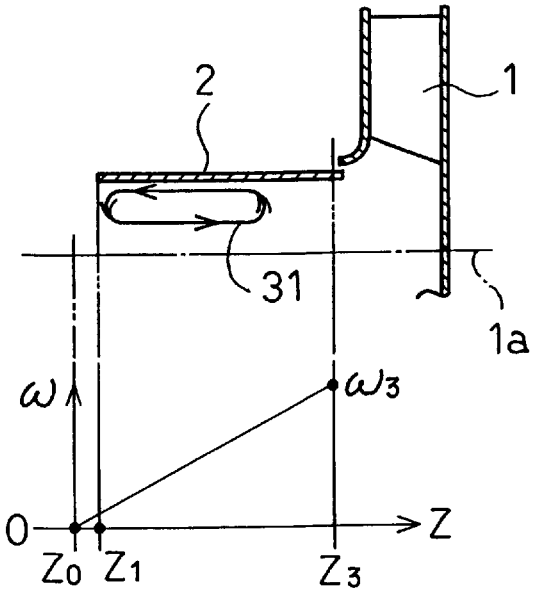
FIG. 9 is a model drawing without a by-pass unit for disclosing 'Function (a)' in the case that no ducting system is equipped on the inlet side of a fan and a suction pipe is opened to the atmosphere.
Figure 10:
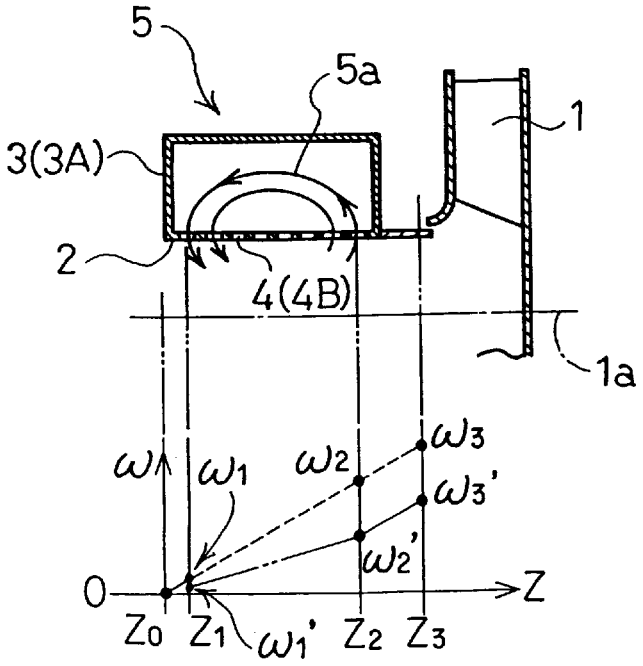
FIG. 10 is a model drawing with a by-pass unit for disclosing 'Function (a)' in the case that no ducting system is equipped on the inlet side of a fan and a suction pipe is opened to the atmosphere.

Each item is described by comparing an example equipped with a by-pass unit for controlling the prerotation of flow with an example without it as follows:

[Function (a)] On the mechanism for transforming the energy based on the tangential velocity of prerotation flow in a suction pipe 2 into the effective work:

FIG. 7 and FIG. 8 are examples providing with a ducting system on the inlet side of a fan, and the suction pipe 2 connected thereto is straight and reasonably long. FIG. 7 is an example without a by-pass unit and FIG. 8 is an example with it. FIG. 9 and FIG. 10 are examples not providing with a ducting system on the inlet side of a fan, and the suction pipe 2 applied thereto is shirt and is opened to the atmosphere. FIG. 9 is an example without a by-pass unit and FIG. 10 is an example with it.

Under the steady running of a fan off the designing normal capacity the air flowing into the impeller 1 begins to have the angular velocity of the prerotation at the position $Z_0$ upstream the impeller (supposedly $Z_0 \approx Z_1$ in FIG. 9 and FIG. 10), and the prerotation accelerated thereafter results in possessing the angular velocity $\omega_3$ at the position $Z_3$ in close vicinity to the impeller. The position $Z_3$ in close vicinity to impeller means a critical position where the air flowing into an impeller is not directly pressurized by impeller blades, and $Z_3$ is an extremely approximate value to the reference point $Z_P$ mentioned above.

$\omega_3'$ shown in FIG. 8 and FIG. 10 means that the air losing a half of the tangential velocity component at the effective region of $Z_1$ to $Z_2$ for by-passing as shown in equation (5) mentioned after possesses the angular velocity $\omega_3'$ at the position of $Z_3$ by receiving the effect of angular acceleration again at the region of $Z_2$ to $Z_3$ in close vicinity to an impeller. It is supposed that the inclination of a straight line connecting $Z_0$ to $\omega_3$ is equal to that connecting $\omega_2'$ to $\omega_3'$.

FIG. 8 is essentially different from FIG. 10 on the distance between $Z_0$ and $Z_3$. Such a difference gives a different inclination of the straight line connecting $Z_0$ to $\omega_3$, and tends to affect the angular velocity $\omega_1$ of the prerotation at the position of $Z_1$ and the angular velocity $\omega_2$ of the prerotation at the position of $Z_2$, moreover, the angular velocity $\omega_3'$ of the prerotation at the position of $Z_3$ in dependence on the difference of the distance between $Z_2$ and $Z_3$.

The above-mentioned $\omega_1$ is the angular velocity of the prerotation generated at the position $Z_1$ in the case without a by-pass unit for controlling the prerotation of flow, and $\omega_1'$ is the angular velocity of the prerotation generated at the position $Z_1$, which is reduced by the by-pass flow 5*a* according to the by-pass unit 5 for controlling the prerotation of flow. Similarly, $\omega_2$ is the angular velocity of the prerotation generated at the position $Z_2$ in the case without a by-pass unit for controlling the prerotation of flow, and $\omega_2'$ is the angular velocity of the prerotation generated at the position $Z_2$, which is reduced by the by-pass flow 5*a* according to the by-pass unit 5 for controlling the prerotation of flow. Furthermore, $\omega_3$ is the angular velocity of the prerotation generated at the position $Z_3$ in the case without a by-pass unit for controlling the prerotation of flow, and $\omega_3'$ is the angular velocity of the prerotation generated at the position $Z_3$, which is reduced by the by-pass flow 5*a* according to the by-pass unit 5 for controlling the prerotation of flow.

As indicated in FIG. 7 and FIG. 9, reverse flow 31 (vortex flow) generates nearby the inner wall of suction pipe in the case without a by-pass unit. As indicated in FIG. 8 and FIG. 10, by-pass flow 5*a* as reverse flow (circulating flow) generates through a closed spatial region enabling the air to flow in the case with a by-pass unit. Such a mechanism is shown by means of a model having a by-pass unit indicated in FIG. 8 and FIG. 10 as follows:

The prerotation in the suction pipe 2 is forced vortex motion because it has tangential velocity induced by the energy of impeller 1. According to 'Hydraulics' authored by Matsuki ITAYA, Feb. 15, 1974, 14th edition, pages 73 to 75, a general equation of the pressure energy on forced vortex motion is as follows:

$$P=\rho\cdot u^2/2+\rho\cdot u^2/2$$

The first term of right side means the energy of dynamic pressure, and the second means the energy of static pressure based on centrifugal force. Where $\rho$ is the density of air, and u is the tangential velocity of forced vortex motion, consequently, $P=\rho\cdot u^2$.

According to the aforesaid '2nd Edition Centrifugal and Axial Flow Pumps' authored by A. J. STEPANOFF, page 40, the static pressure based on centrifugal force nearby the inner wall of suction pipe in prerotation flow field is $+\rho\cdot u^2/2\cdot ½$, and the static pressure based on centrifugal force nearby the center of a suction pipe is $-\rho\cdot u^2/2\cdot ½$. As a result, the total of both static pressure is as follows:

$$+\rho\cdot u^2/2\cdot ½-(-\rho\cdot u^2/2\cdot ½)=\rho\cdot u^2/2$$

In the by-pass units 5 of FIG. 8 and FIG. 10, the transmittable pressure energy in all pressure energy based on the prerotation as forced vortex motion is the static pressure, $+\rho\cdot u^2/2\cdot\frac{1}{2}=\rho/4\cdot u^2$, based on the centrifugal force. Therefore, the static pressure based on the prerotation, which is transmitted by a by-pass unit on the inner wall of suction pipe, is expressed as follows: The static pressure $P_1$ transmitted at the position $Z_1$ indicated in FIG. 8 and FIG. 10 is $\rho/4\cdot u_1^2$, and the static pressure $P_2$ transmitted at the position $Z_2$ is $\rho/4\cdot u_2^2$.

Assuming that the diameter of suction pipe 2 is constant at any position of Z on the axis of the pipe, the radius from the center of the suction pipe to the inner wall thereof is denoted by $r_0$, the angular velocity of the prerotation at the position $Z_1$ is by $\omega_1$, that at $Z_2$ is by $\omega_2$, it will be $u_1=r_0\cdot\omega_1$ and $u_2=r_0\cdot\omega_2$. Moreover, $P_1$ and $P_2$ are expressed as follows:

$$P_1=\rho\cdot(r_0\cdot\omega_1/2)^2 \quad (1)$$

$$P_2=\rho\cdot(r_0\cdot\omega_2/2)^2 \quad (2)$$

FIG. 1 shows a detailed model drawing of the by-pass unit shown in FIG. 8 and FIG. 10. In the Figure, $r_0$ is a radius from the center of suction pipe to the inner wall thereof, $P_c$ is the static pressure in the closed spatial region of by-pass unit, $P_1$ is the static pressure transmitted at the position $Z_1$, $P_2$ is the static pressure transmitted at the position $Z_2$, $S_1$ is the area of opening portion of by-pass unit at the position $Z_1$, $S_2$ is the area of opening portion of by-pass unit at the position $Z_2$, $v_1$ is the velocity of the air flowing from the opening portion of by-pass unit into the suction pipe at the position $Z_1$, and $v_2$ is the velocity of the air flowing from the suction pipe into the opening portion of by-pass unit at the position $Z_2$.

'Hydrodynamics Engineering' authored by Yoshimasa FURUYA et al. Sep. 1, 1979, 1st edition, 19th print (published by Asakura Co. Ltd.,), pages 34 and 35, teaches a following matter: A total of the work based on the static pressure transmitted to the air in the closed spatial region of by-pass unit is equal to the variation of kinetic energy of the air in the closed spatial region of by-pass unit.

The above-mentioned matters are formulated as follows: A total of the work per unit time based on the static pressure transmitted to the air in the closed spatial region of by-pass unit is denoted by W.

$$\begin{aligned} W &= (P_2 - P_c)\cdot S_2\cdot v_2 + (P_1 - P_c)\cdot S_1\cdot(-v_1) \\ &= P_2\cdot S_2\cdot v_2 - P_c\cdot S_2\cdot v_2 - P_1\cdot S_1\cdot v_1 + P_c\cdot S_1\cdot v_1 \end{aligned}$$

Since $S_2\cdot v_2=S_1\cdot v_1$ is given according to the continuous equation, it will be $W=(P_2-P_1)\cdot S_1\cdot v_1$. The variation per unit time of kinetic energy of the air in the closed spatial region of by-pass unit is denoted by E, and the density of air is by $\rho$, a following equation is obtained.

$$\begin{aligned} E &= 1/2\cdot\rho\cdot S_1\cdot v_1\cdot v_1^2 - 1/2\cdot\rho\cdot S_2\cdot v_2\cdot v_2^2 \\ &= 1/2\cdot\rho\cdot S_1\cdot v_1\cdot(v_1^2 - v_2^2) \end{aligned}$$

if E=W, a following equation is given.

$$\tfrac{1}{2}\cdot\rho\cdot S_1\cdot v_1\cdot(v_1^2-v_2^2)=(P_2-P_1)\cdot S_1\cdot v_1$$

A following equation (3) is obtained from the above-mentioned equation.

$$\tfrac{1}{2}\cdot\rho\cdot v_1^2=(P_2-P_1)+\tfrac{1}{2}\cdot\rho\cdot v_2^2 \quad (3)$$

A following equation (4) is given by substituting equations (1) and (2) for equation (3).

$$\tfrac{1}{2}\cdot\rho\cdot v_1^2=\tfrac{1}{4}\cdot\rho\cdot r_0^2\cdot(\omega_2^2-\omega_1^2)+\tfrac{1}{2}\cdot\rho\cdot v_2^2$$

$$v_1^2=\tfrac{1}{2}\cdot r_0^2\cdot(\omega_2^2-\omega_1^2)+v_2^2 \quad (4)$$

Equation (4) teaches that the energy of static pressure based on the prerotation can be transformed to the kinetic energy of air in a by-pass unit.

The radius from the center of a suction pipe to the inner wall thereof is treated to be constant at any position Z on the axis of the pipe for getting equation (4). Next, the case that the radius is different in dependence of the position Z as shown in FIG. 3 is as follows: The radius at the position of $Z_1$ is denoted by $r_1$, the radius at the position of $Z_2$ is by $r_2$, and $r_1>r_2$. Referring to the term of $\frac{1}{2}\cdot r_0^2\cdot(\omega_2^2-\omega_1^2)$ of the equation (4), this can be changed to $\frac{1}{2}\cdot(r_2^2\cdot\omega_2^2-r_1^2\cdot\omega_1^2)$. Though $r_1>r_2$ as assumed, the term of $\frac{1}{2}\cdot(r_2^2\cdot\omega_2^2-r_1^2\cdot\omega_1^2)$ is not always positive since $\omega_1<\omega_2$ is supposed.

In other words, the by-pass unit under such circumstances is not always able to guarantee transforming the energy of static pressure based on the prerotation into the kinetic energy of air. Therefore, the length of the communicating portion having diameter gradually reduced, which is the truncated cone portion $\mathbf{2}a_1$, $\mathbf{2}a_2$, . . . , $\mathbf{2}a_{n-1}$ at 'the region ahead of an impeller' in suction pipe 2 of a fan, can not be regarded as an effective region for by-passing.

The following description is basics of the technical creation according to the present invention, the new conception of which has not been found in the state of the art. The behavior of the air accompanying with the prerotation in the effective region for by-passing is considered as follows: The static pressure transmitted to the air in the closed spatial region of by-pass unit at the position of radius $r_0$, which is equal to the distance between the center of a suction pipe and the inner wall thereof, is $\rho/4\cdot r_0^2\cdot\omega^2$, where $\omega$ is the angular velocity of prerotation. Since the energy of static pressure does not appear without the tangential velocity of the prerotation flow, the kinetic energy, $\rho/2\cdot r_0^2\cdot\omega^2$, of the tangential velocity of the air with prerotation will disappear by the work which the static pressure of $\rho/4\cdot r_0^2\cdot\omega^2$ acts on the air in the closed spatial region of by-pass unit.

Since the total energy based on the tangential velocity of the air with prerotation is essentially $\rho\cdot r_0^2\cdot\omega^2$ at the position of radius $r_0$ from the center of the inner suction pipe to the inner wall thereof, the energy based on the tangential velocity as shown in a following equation is considered to be maintained in the air accompanying with prerotation.

$$(1-\tfrac{1}{4}-\tfrac{1}{2})\cdot\rho\cdot r_0^2\cdot\omega^2=\rho/4\cdot r_0^2\cdot\omega^2$$

Then, two equations described after are obtainable. The physical meaning of the equations is as follows: Though the angular velocity of prerotation can not be actually observed at the position $r=r_0$ on the inner radius of the suction pipe, equation (5) teaches that the air having the component of tangential velocity actually exists as if it had potentially the energy corresponding to one based on the angular velocity of $\omega/2$.

$$\rho/4\cdot r_0^2\cdot\omega^2=\rho\cdot r_0^2\cdot(\omega/2)^2 \quad (5)$$

$$\rho/4\cdot r_0^2\cdot\omega^2=\rho\cdot(r_0/2)^2\cdot\omega^2 \quad (6)$$

On the other hand, the equation (6) teaches that the air having the velocity component in the tangential direction, which appears based on the angular velocity $\omega$ of prerotation, exists at the position $r=r_0/2$ on the inner radius of the suction pipe, and that the air not having the velocity component in the tangential direction exists at the region of $r_0/2<r\leqq r_0$ on the inner radius of the suction pipe. What is actually observed is the state of expression according to equation (6).

To sum up the above-mentioned, at the region of $0\leqq r\leqq r_0/2$ on the inner radius of a suction pipe the air flow accompanying with the prerotation in the effective region for by-passing is the air flow originally having angular velocity ω, and at the region of $r_0/2<r\leqq r_0$ on the inner radius of a suction pipe the air flow having velocity $v_1$ in the direction of impeller 1, which is expressed in equation (4), appears without angular velocity.

Since there is the air flow having the velocity component in tangential direction at the region of $0\leqq r\leqq r_0/2$ on the inner radius of a suction pipe, the static pressure rise based on tangential velocity appears in the vicinity of the position r=ro/2 on the inner radius of a suction pipe. Accordingly, the direction of the air flowing into the suction pipe at initial velocity vi from the opening $\mathbf{4}d_1$ of by-pass unit is finally changed to the direction of an impeller as if the air collided with an air cushion. Because the static pressure rise in the vicinity of the position $r=r_0/2$ on the inner radius of a suction pipe prevents the air from keeping the direction of the initial velocity in spite that the air with the initial velocity flows toward the center of a suction pipe.

According to the mechanism described before, a part of energy based on tangential velocity (formulated in equation (4)) of the air with the prerotation generated at 'the region ahead of an impeller' inside a suction pipe can be transformed into the effective work which the impeller 1 acts on the air. Simultaneously, according to equation (5) the air accompanying with prerotation is changeable to the air losing a half of the initial angular velocity.

To realize these function effectively, i.e., to perform the function mentioned above perfectly in all effective region of the by-pass unit for controlling prerotation following circumstances are required. The by-pass routes enabling to transmit the air pressure and to introduce the air should be uniformly provided all over the by-passing effective region of the suction pipe composing of a part of the by-pass unit, in which the air flows toward the fan impeller. Therefore, it is comprehensible that plural, i.e., not single, by-pass routes formed by the closed spatial region and the communicating passages should be prepared on the suction pipe as shown in FIG. 8 and FIG. 10 indicating some by-pass flows.

The plural by-pass flow 5*a* are realized by more than three of communicating passages 4 equipped along the flowing direction of suction air. For example, referring to FIG. 8, the by-pass flow is able to pass through more than two of communication holes on the upstream side via one of them on the downstream side, of course, is also able to pass through one of them on the upstream side via two of them on the downstream side. In general, the by-pass routes should be provided so that the by-pass flow can appear uniformly as mentioned above, i.e., so that the by-pass air can flow into the air chamber 3 through some of communication holes on the downstream side and into the suction pipe through some of them on the upstream side. Therefore, the uniform by-pass flow can not be established in the case that two only of communication holes are equipped along the flowing direction of suction air.

Figure 11:
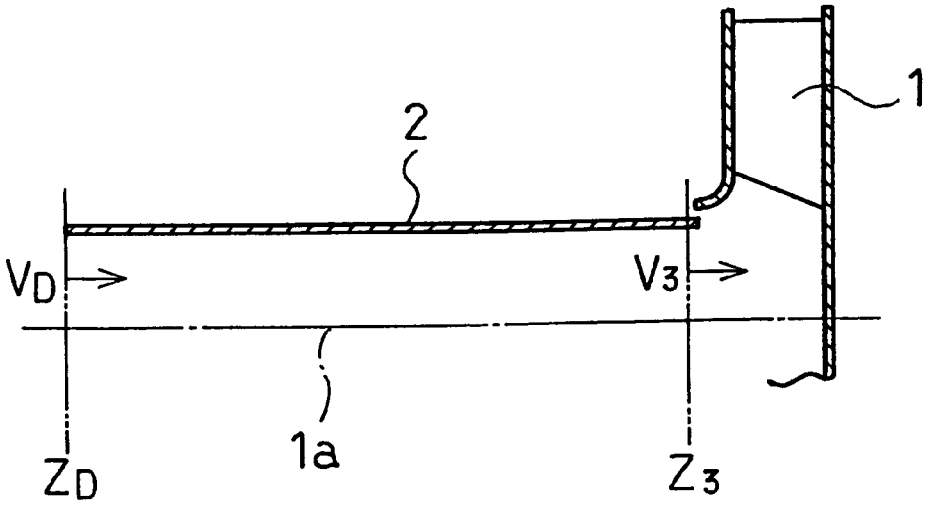
FIG. 11 is a model drawing without a by-pass unit for disclosing 'Function (b)' on the reason why the shaft power of a fan is reduced by the transformation of the energy based on the tangential velocity of prerotation flow into the effective work in the case that a ducting system is equipped on the inlet side of a fan and a suction pipe is straight and reasonably long.
Figure 12:
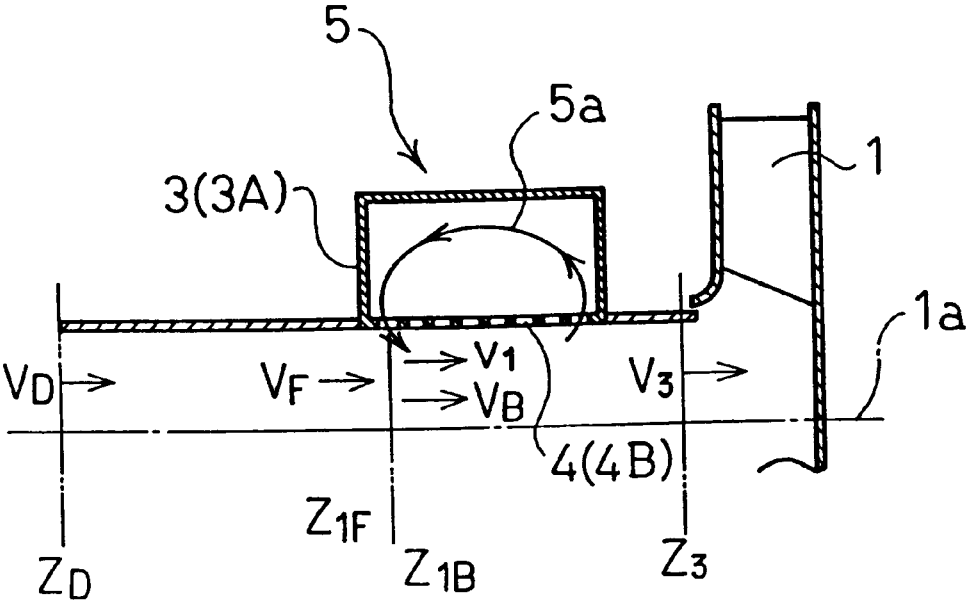
FIG. 12 is a model drawing with a by-pass unit for disclosing 'Function (b)' in the case that a ducting system is equipped on the inlet side of a fan and a suction pipe is straight and reasonably long.

[Function (b)] On the reason why the shaft power of a fan is reduced by the transformation of the energy based on the tangential velocity of prerotation flow into the effective work:

FIG. 11 and FIG. 12 are examples providing with a ducting system on the inlet side of a fan, and the suction pipe 2 connected thereto is straight and reasonably long. FIG. 11 is an example without a by-pass unit and FIG. 12 is an example with it. $Z_D$ in the drawings is the position where the velocity of the air flowing in the direction of an impeller is equal to 0, $Z_3$ is the position in close vicinity to an impeller, $Z_{1F}$ is the position just before the effective region for by-passing, $Z_{1B}$ is the position just behind the effective region for by-passing, $V_D$ is the mean velocity of air flow at position $Z_D$ where the air flows toward an impeller inside a suction pipe, $V_3$ is the mean velocity of the air flow at position $Z_3$ where the air flows toward an impeller 1 inside a suction pipe, $V_F$ is the mean velocity of the air flow at position $Z_{1F}$ where the air flows toward an impeller inside a suction pipe, $V_B$ is the mean velocity of the air flow at position $Z_{1B}$ where the air flows toward an impeller inside a suction pipe, $v_1$ is the velocity of the air flow at position $Z_{1B}$, the direction of which is changed to the direction of an impeller after flowing from the opening portion of by-pass unit into a suction pipe, being identical to the velocity $v_1$ of the air flow at position $Z_1$ in FIG. 1, where the air flows from the opening portion of by-pass unit into a suction pipe.

According to 'Hydrodynamics Engineering' authored by Yoshimasa FURUYA et al., Sep. 1, 1979, 1st edition, 19th print (published by Asakura Co. Ltd.,), page 34 and 35, teaches a following matter: The total of the work which an impeller acts on the air flow between the positions $Z_D$ and $Z_3$ is equal to the difference between kinetic energy of the air at position $Z_3$ and that at position $Z_D$.

In the model shown in FIG. 11, a total of the work which an impeller acts on the air is denoted by $E_6$, and in the model shown in FIG. 12, a total of the work which an impeller acts on the air is by $E_7$, therefore, ΔE in the following equation indicates the decrement of the work which an impeller acts on the air under the circumstances with a by-pass unit, in other words, being equal to an amount of reduction of the fan shaft power for driving an impeller.

$$\Delta E=E_6-E_7 \tag{7}$$

The above-mentioned matters are formulated as follows: ρ is the density of air, Q is the capacity per unit time of the air flowing through a suction pipe, $Q_1$ is the capacity of the air with velocity $v_1$ at position $Z_{1B}$, the direction of which is changed to the direction of an impeller after flowing from the opening portion of by-pass unit into a suction pipe, and $Q_2$ is the capacity of the air after subtracting $Q_1$ from Q.

$$E_6=\tfrac{1}{2}\cdot\rho\cdot Q\cdot V_3^2-\tfrac{1}{2}\cdot\rho\cdot Q\cdot V_D^2$$

According to the definition, $V_D=0$, therefore a following equation is obtained.

$$E_6=\tfrac{1}{2}\cdot\rho\cdot Q\cdot V_3^2 \tag{8}$$

$E_7$ is treated at the range between the position $Z_D$ and the position $Z_{1F}$ and at the range between the position $Z_{1B}$ and the position $Z_3$, respectively.

$$E_7=[\tfrac{1}{2}\cdot\rho\cdot Q\cdot V_F^2-\tfrac{1}{2}\cdot\rho\cdot Q\cdot V_D^2]+[\tfrac{1}{2}\cdot\rho\cdot Q\cdot V_3^2-(\tfrac{1}{2}\cdot\rho\cdot Q_1\cdot v_1^2+\tfrac{1}{2}\cdot\rho\cdot Q_2\cdot V_B^2)]$$

According to the definition, $V_D=0$, therefore a following equation is obtained.

$$E_7=\tfrac{1}{2}\cdot\rho\cdot Q\cdot V_F^2+\tfrac{1}{2}\cdot\rho\cdot Q\cdot V_3^2-\tfrac{1}{2}\cdot\rho\cdot Q_1\cdot v_1^2-\tfrac{1}{2}\cdot\rho\cdot Q_2\cdot V_B^2 \tag{9}$$

A following equation is given by substituting equations (8) and (9) for equation (7).

$$\Delta E = 1/2\cdot\rho\cdot Q\cdot V_3^2 - 1/2\cdot\rho\cdot Q\cdot V_F^2 - 1/2\cdot\rho\cdot Q\cdot V_3^2 + 1/2\cdot\rho\cdot Q_1\cdot v_1^2 + 1/2\cdot\rho\cdot Q_2\cdot V_B^2 = 1/2\cdot\rho\cdot Q_1\cdot v_1^2 + 1/2\cdot\rho\cdot Q_2\cdot V_B^2 - 1/2\cdot\rho\cdot Q\cdot V_F^2$$

According to the definition, $Q=Q_1+Q_2$, therefore a following equation is obtained.

$$\Delta E=\tfrac{1}{2}\cdot\rho\cdot Q_1\cdot(v_1^2-V_F^2)+\tfrac{1}{2}\cdot\rho\cdot Q_2\cdot(V_B^2-V_F^2) \quad (10)$$

Under the condition that the suction pipe 2 is opened to the atmosphere as shown in FIG. 10, $V_F\approx 0$ at the region of the capacity $Q_1$ of air flow and $V_B\approx V_F$ at the region of the capacity $Q_2$ of air flow, therefore equation (10) comes to $\Delta E=\tfrac{1}{2}\cdot\rho\cdot Q_1\cdot v_1^2$. Consequently, the disappearance of all of kinetic energy of the air having the velocity expressed by equation (4) contributes to the reduction of the shaft power of a fan.

[Function (c)] On the reason why the pressure rise based on the impeller of a fan is increased by the decrease of velocity component in the tangential direction of the prerotation flow:

According to 'Hydrodynamics Engineering' authored by Yoshimasa FURUYA et al., Sep. 1, 1979, 1st edition, 19th print (published by Asakura Co. Ltd.,), page 249 to 253, teaches a following general equation when the pressure rise by means of the impeller of a fan is denoted by ΔP.

$$\Delta P=\tfrac{1}{2}\cdot\rho\cdot(U_3^2-U_0^2)-\tfrac{1}{2}\cdot\rho\cdot(W_3^2-W_0^2) \quad (11)$$

Where ρ is the density of air, $U_0$ is the tangential velocity of air flow just before the entrance of an impeller channel, $U_3$ is the tangential velocity of air flow just behind the exit of an impeller channel, $W_0$ is the relative velocity of air flow along the impeller channel just before the entrance thereof, $W_3$ is the relative velocity of air flow along the impeller channel just behind the exit thereof. In the case of the operation of a fan at certain constant capacity of air flow $U_3$, $W_3$ and $W_0$ are deemed constant whether the prerotation generates just before the entrance of impeller channel or not.

Next, the case that the tangential velocity based on the prerotation just before the entrance of the impeller channel is various is considered as follows: In view of the equation (11) it is obvious that the smaller the value of $U_0$ is, the larger the pressure rise ΔP by a fan impeller is, as far as a fan is driven under certain constant capacity. Namely, after the angular velocity of the air flow with prerotation in the by-pass unit for controlling the prerotation of flow is reduced by half, the smaller the velocity component in the tangential direction becomes, the larger the pressure rise by a fan impeller becomes.

[Function (d)] On the qualitative explanation of the decrease of fan noise according to the by-pass unit for controlling the prerotation of flow:

The case that the by-pass unit for controlling the prerotation of flow is not equipped as shown in FIG. 7 and FIG. 9 is examined: As mentioned in [Function (a)], according to the influence of the static pressure based on the tangential velocity of the prerotation of flow, the negative pressure in a negative pressure field induced by a fan impeller nearby the center of a suction pipe becomes much higher.

Oppositely, the negative pressure in a negative pressure field becomes lower nearby the inner wall of a suction pipe. Since the air flowing toward an impeller in a suction pipe is highly accelerated according to the high negative pressure nearby the center of a suction pipe, it results in having high velocity just before the entrance of an impeller channel. On the other hand, since the air is not highly accelerated nearby the inner wall of a suction pipe for the sake of the low negative pressure, it merely has low velocity also just before the entrance of an impeller channel. As a result, just before the entrance of an impeller channel the air is excessively gathering nearby the center of an impeller, and the air can not enter the impeller channel and stays there, generating the stagnation of flow in the vicinity of the center of the impeller. It can be considered that such behavior promotes the turbulent flow noise in fan noise.

Whereas, in the by-pass unit 5 for controlling the prerotation of flow as shown in FIG. 8 and FIG. 10, such a by-pass unit contributes to suppress any behavior mentioned above, generating a comparatively uniform pressure field in negative pressure field of a suction pipe. Therefore, the air flowing toward an impeller 1 results in having comparatively uniform velocity just before the entrance of an impeller channel, and it is not excessively gathered at a certain spot. Accordingly, the air does not stagnate but flows smoothly into the impeller channel, and the improvement of the air flow just before the entrance of an impeller channel by means of the by-pass unit for controlling the prerotation of flow prevents the turbulent flow noise from generating.

In the aforementioned centrifugal flow fan, $Z_{Pc}$ shown in FIG. 4(*a*) is chosen as the reference point $Z_P$ in the case that a mouth ring is attached to the side plate which is fixed to the blades on the side of a suction pipe. Unless a side plate is fixed to the blades on the side of a suction pipe along the impeller axis of a centrifugal flow fan, following reference points are adopted. Naturally, equations (a), (b), (c) and (d) described above are directly applicable to such cases according to the technical philosophy of the present invention, which has been also confirmed by the inventors.

As shown in FIG. 4(*a*), when the entrance end $p_{a1}$ of blades on the side edge located at the side of a suction pipe of the blades $\mathbf{1}A_1$ of a centrifugal flow impeller is closer to the suction pipe than the discharge end $p_{a2}$ thereof along the impeller axis 1*a*, a point $Z_{Pa}$ on the impeller axis corresponding to the entrance end $p_{a1}$ of blades is chosen as a reference point. On the other hand, as shown in FIG. 4(*b*), when the discharge end $p_{b2}$ is closer to the suction pipe than the entrance end $p_{b1}$ along the impeller axis 1*a*, a point $Z_{Pb}$ on the impeller axis corresponding to the discharge end $p_{b2}$ is chosen as a reference point.

Figure 5:
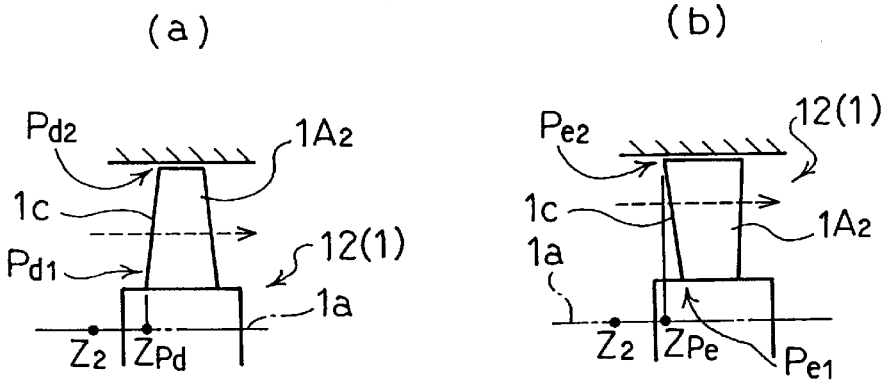
FIG. 5 is a drawing showing the reference points of axial flow fan, (a) is a model drawing which the root on the upstream edge of the blades is closer to the suction pipe than the tip thereof along the impeller axis, and (b) is a model drawing which the tip is closer to the suction pipe than the root along the impeller axis.

In the case of an axial flow fan 12 as shown in FIG. 5(*a*), when the root $p_{d1}$ on the upstream edge 1*c* of the blades $\mathbf{1}A_2$ of an axial flow impeller is closer to the suction pipe than the tip $p_{d2}$ thereof along the impeller axis 1*a*, a point $Z_{Pd}$ on the impeller axis corresponding to the root $p_{d1}$ is chosen as a reference point. On the other hand, as shown in FIG. 5(*b*), when the tip $P_{e2}$ on the upstream edge 1*c* of the impeller blades $\mathbf{1}A_2$ is closer to the suction pipe than the root $p_{e1}$ thereof along the impeller axis 1*a*, a point $Z_{Pe}$ on the impeller axis corresponding to the tip $p_{e2}$ is chosen as a reference point.

Figure 6:
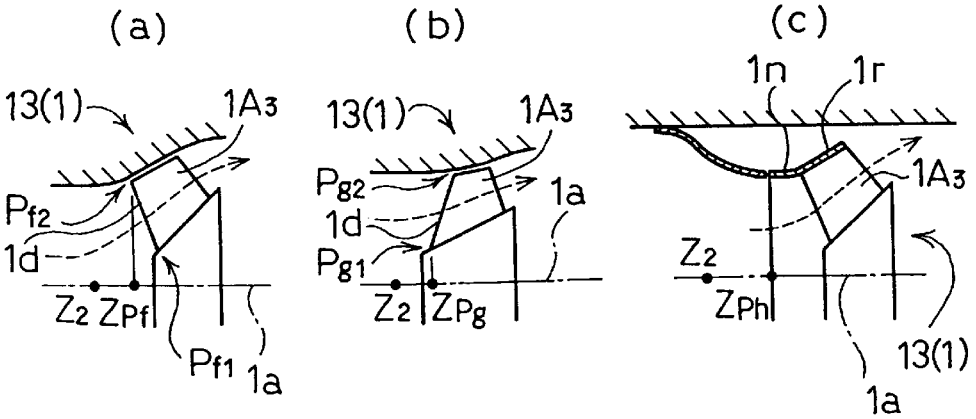
FIG. 6 is a drawing showing the reference points of mixed flow fan, (a) is a model drawing which the tip on the upstream edge of the impeller blades is closer to the suction pipe than the root thereof along the impeller axis in the case that neither a side plate nor a mouth ring is provided with the blades, (b) is a model drawing which the root is closer to the suction pipe than the tip along the impeller axis, and (c) is a model drawing in the case that a mouth ring is attached to the side plate which is fixed to the blades on the side of a suction pipe.

In the case of a mixed flow fan, as shown in FIG. 6(*c*) if a side plate 1*r* is fixed to the edge of the blades $\mathbf{1}A_3$ of a mixed flow impeller and a mouth ring 1*n* is attached the side plate 1*r*, the point $Z_{Ph}$ on the impeller axis 1*a* corresponding to the most upstream point of the mouth ring 1*n* is chosen as a reference point.

In the case of a mixed flow fan without side plates at the blade tip, as shown in FIG. 6(*a*), when the tip $p_{f2}$ on the upstream edge 1*d* of the impeller blades $\mathbf{1}A_3$ is closer to the suction pipe than the root $p_{f1}$ thereof along the impeller axis 1*a*, a point $Z_{Pf}$ on the impeller axis corresponding to the tip $p_{f2}$ is chosen as a reference point. On the other hand, as shown in FIG. 6(*b*), when the root $p_{g1}$ on the upstream edge 1*d* of the impeller blades is closer to the suction pipe than the tip $p_{g2}$ along the impeller axis, a point $Z_{Pg}$ on the impeller axis corresponding to the root $p_{g1}$ is chosen as a reference point.

Figure 13:
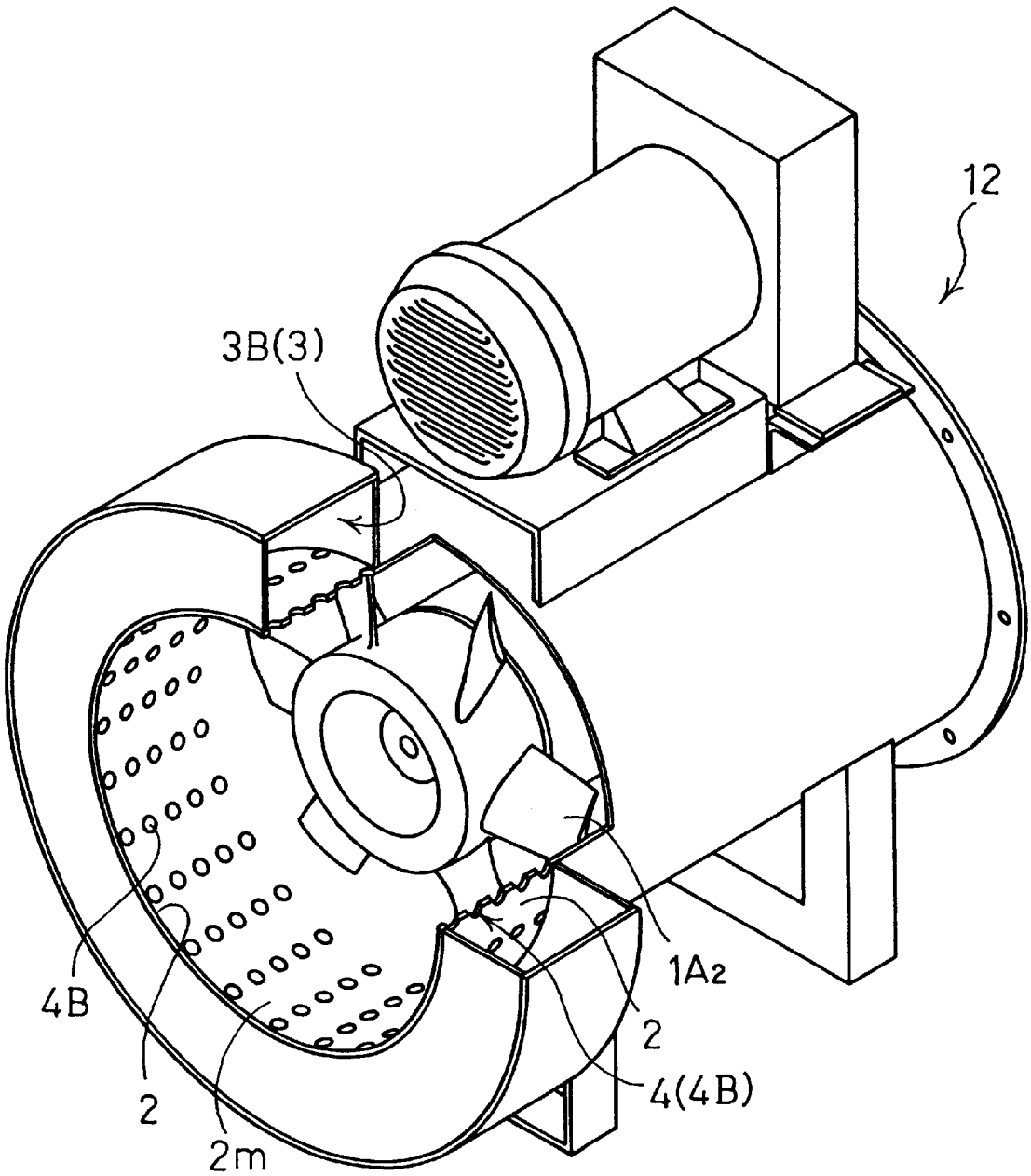
FIG. 13 is a schematic view of one of an axial flow fan as an example A to which a by-pass unit for controlling the prerotation of flow of a fan concretely applied.
Figure 14:
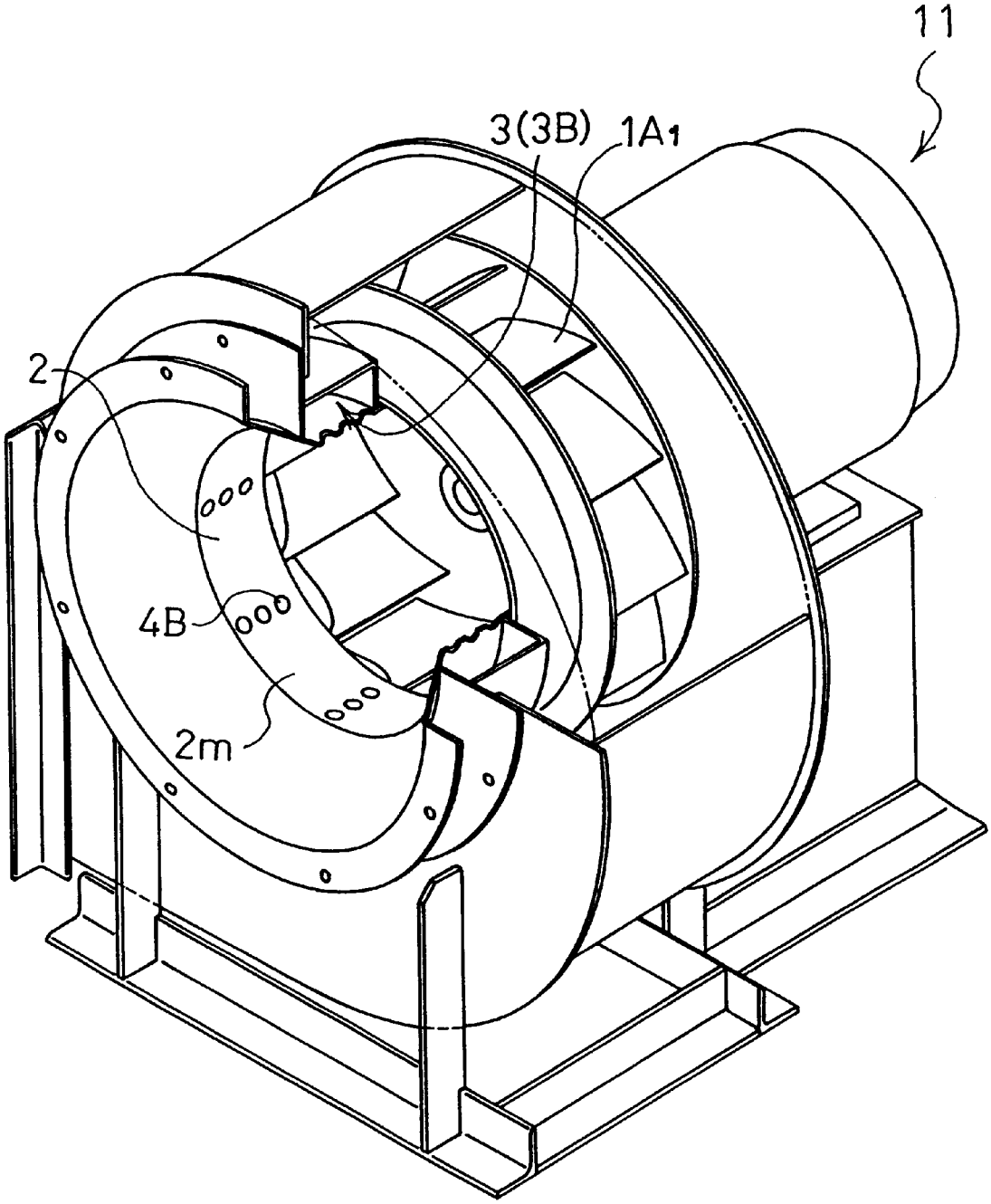
FIG. 14 is a schematic view of one of an centrifugal flow fan as an example B to which a by-pass unit for controlling the prerotation of flow of a fan concretely applied.
Figure 15:
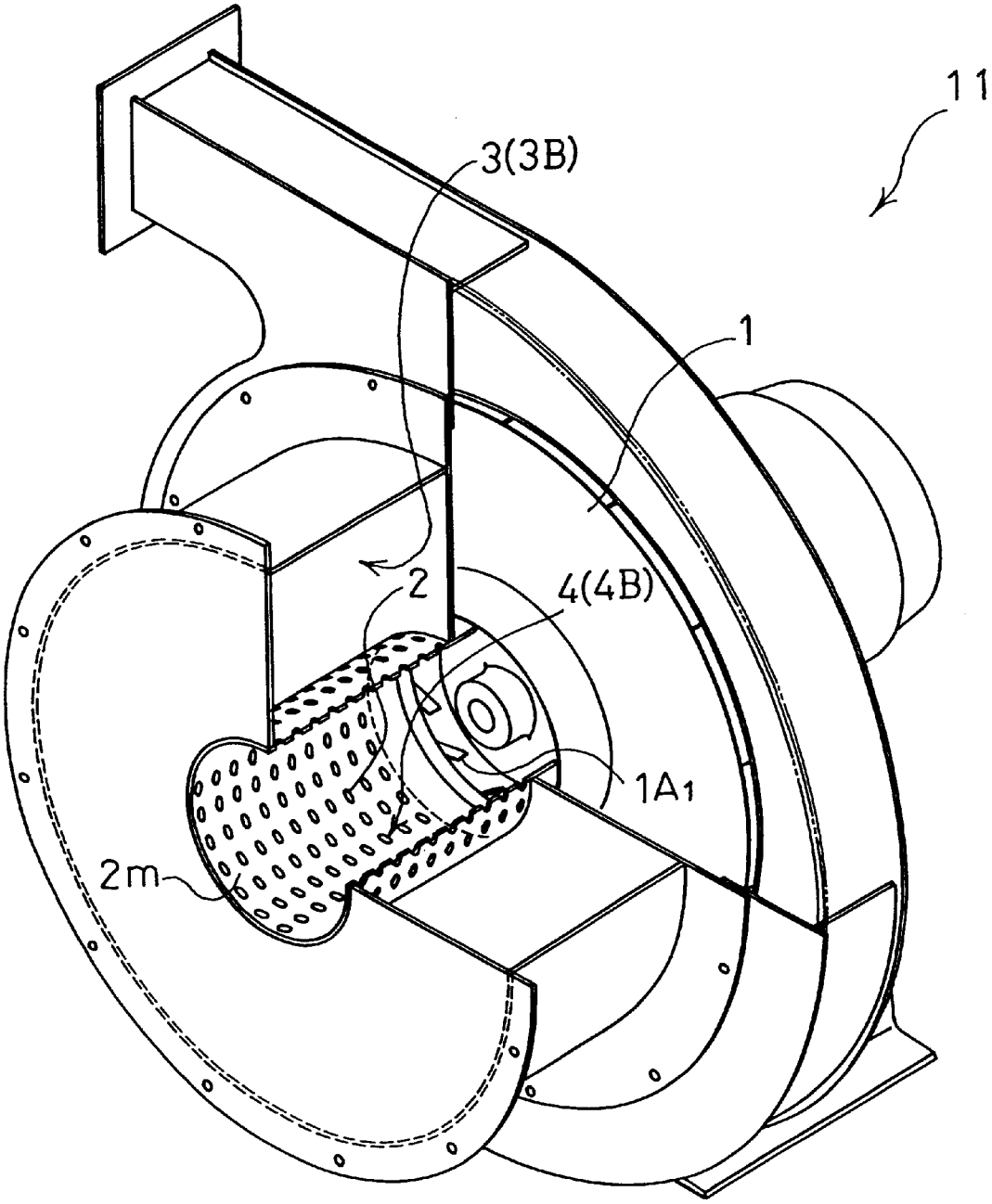
FIG. 15 is a schematic view of one of an centrifugal flow fan as an example C to which a by-pass unit for controlling the prerotation of flow of a fan concretely applied.

In the aforementioned example, referring to FIG. 1, the air chamber 3 forming a closed spatial region is a box 3A equipped on the outside of the suction pipe 2 and communication passages 4 are tubes 4A connecting the box to the suction pipe. In stead of such an air chamber and communicating passages, as shown in FIGS. 13 to 15, a cylindrical closed chamber 3B formed on the periphery of 'the region ahead of an impeller' of the suction pipe 2 is applicable to an air chamber 3 forming a closed spatial region, and holes 4B punched on the peripheral wall 2*m* of a suction pipe, which partitions off the cylindrical closed chamber and the suction pipe, are applicable to communicating passages 4, resulting in exhibiting same effect.

In the case that a cylindrical closed chamber is adopted as an air chamber, it will be designed in consideration of the installation on the fan newly manufactured. On the other hand, in the case that the by-pass unit comprises a box 3A and tubes 4A as shown in FIG. 2 they are advantageously available for the fans already operated, too. Referring to the drawings indicating a cylindrical closed chamber as an air chamber, of course, it can possess more than three communicating passages disposed along the flowing direction of suction air. In addition, the disposal of plural rows comprising of communicating passages on the circumferential surface of the cylindrical closed chamber will promote the effect according to the by-pass unit. Therefore, several rows, more than three communicating passages each, are applicable to FIG. 2 instead of a row of tubes.

As the mentioned above, the by-pass routes are established by means of an air chamber and communicating passages so that the transmission of air pressure and the introduction of air can be maintained between a suction pipe and an air chamber through the communicating passages. Thereby, the by-pass flow generated in a part of suction air can rationally control the energy based on the tangential velocity of the prerotation flow induced at 'the region ahead of an impeller' of a fan.

According to the present invention, the reduction of the shaft power of a fan and the increase of the pressure rise owing to a fan impeller are promoted so that the fan efficiency can be improved 2% to 9%, and the control of air flow at 'the region ahead of an impeller' inside a suction pipe can accomplish the reduction of fan noise of 1.5 dB to 4 dB. The concrete examples relating to the reduction of fan noise are described as follows: Incidentally, even the decrement of 2 dB remarkably contributes the reduction of noise in the case of a fan indoors.

Table 3 shows the main specifications of the examples of A to E, to which the by-pass units for controlling the prerotation of flow of a fan are concretely applied, referring to the number of drawings.

TABLE 3

| EX | number of referential drawing | kind of fan | outer diameter of impeller mm | rotational speed of of impeller r p m | output power of driving motor KW |
|---|---|---|---|---|---|
| A | FIG. 13 | axial flow type | ϕ290 | 2,960 | 0.4 |
| B | FIG. 14 | centrifugal flow type | ϕ365 | 3,520 | 3.7 |
| C | FIG. 15 | centrifugal flow type | ϕ540 | 2,950 | 3.7 |
| D | (FIG. 15) | centrifugal flow type | ϕ540 | 2,950 | 3.7 |
| E | FIG. 2 | centrifugal flow type | ϕ540 | 2,950 | 3.7 |

| EX | number of referential drawing | kind of fan | circumstances upstream the effective region of by-pass unit for controlling prerotation of flow |
|---|---|---|---|
| A | FIG.13 | axial flow type | opening to the atmosphere |
| B | FIG.14 | centrifugal flow type | opening to the atmosphere |
| C | FIG.15 | centrifugal flow type | opening to the atmosphere |
| D | (FIG.15) | centrifugal flow type | straight duct of 250 mm in diameter, 2.5 m in length |
| E | FIG. 2 | centrifugal flow type | straight duct of 250 mm in diameter, 2.5 m in length |

D is an example which a straight duct is connected with the suction pipe shown in FIG. 15, and the drawing thereof is omitted because it is conceivable from FIG. 15.

Table 4 shows the concrete results of the examples of A to E, to which the by-pass units for controlling the prerotation of flow of a fan are concretely applied, referring to the number of drawings.

TABLE 4

| EX-AMPLE | number of referential drawing | kind of fan | difference of fan efficiency | difference of fan noise | circumstances upstream the effective region of by-pass unit for controlling prerotation of flow |
|---|---|---|---|---|---|
| A | FIG. 13 | axial flow type | 2 | −3.5 | opening to the atmosphere |
| B | FIG. 14 | centrifugal flow type | 8.9 | −2 | opening to the atmosphere |
| C | FIG. 15 | centrifugal flow type | 6.6 | −4 | opening to the atmosphere |
| D | (FIG. 15) | centrifugal flow type | 4.5 | −2.5 | straight duct of 250 mm in diameter, 2.5 m in length |
| E | FIG. 2 | centrifugal flow type | 2.5 | −1.5 | straight duct of 250 mm in diameter, 2.5 m in length |

'The difference of fan efficiency' is equal to 'the efficiency (%) of a fan with a by-pass unit'—'the efficiency (%) of a fan without it', which indicates the value obtained at the point of the best efficiency calculated by using the flow rate and the pressure measured at the outlet side of a fan. 'The difference of fan noise' is 'the noise dB(A) of a fan with a by-pass unit'—'the noise dB(A) of a fan without it', indicating the level at the point of best efficiency. The noise level in the case of a suction pipe opening to the atmosphere is measured at 1 meter in front of the opening of a suction pipe, and the noise level in the case of a suction pipe connected with a straight duct is measured at 1 meter by the side of the connecting portion of a suction pipe to a duct. The composition of Example D is identical to the case of Table 3.

What is claimed is:

1. By-pass unit for controlling the prerotation of flow in a suction pipe of a fan, said suction pipe introduces suction air into an impeller of a fan, comprising;

a communicating means having more than three passages disposed along the flowing direction of suction air and an air chamber means forming a closed spatial region at the outside of 'the region ahead of an impeller' of said suction pipe, said communicating means connects said suction pipe to said air chamber means, thereby, enabling to transmit air pressure from the suction pipe to the air chamber and vice versa and to introduce the suction air thereinto, and forming by-pass routes of the suction pipe in cooperation with the air chamber, resulting in generation of by-pass flow in a part of suction air.

2. By-pass unit for the controlling the prerotation of flow in a suction pipe of a fan according to claim 1, characterized by that said air chamber is a box equipped outside the suction pipe and said communicating passages are tubes connecting said box to the suction pipe.

3. By-pass unit for the controlling the prerotation of flow in a suction pipe of a fan according to claim 1, characterized by that said air chamber is a cylindrical closed chamber formed on the periphery of 'the region ahead of an impeller' of the suction pipe and said communicating passages are the holes punched on the peripheral wall of the suction pipe, which partitions off the cylindrical closed chamber and the suction pipe.

4. By-pass unit for the controlling the prerotation of flow in a suction pipe of a fan according to claim 1, characterized by that said 'the region ahead of an impeller' of the suction pipe comprises n cylindrical portions having different inner diameters along the flowing direction of suction air and truncated cone portions for connecting said cylindrical portions, where a maximum inner diameter is given by $d_{MAX}$ and a minimum is by $d_{MIN}$, and the axial length of the truncated cone portions are $B_i$ (when i=1, 2, 3, . . . and n−1), in the case of a centrifugal flow fan providing no side plate fixed to the blades on the side of a suction pipe along the impeller axis, a point ($Z_{Pa}$) on the impeller axis corresponding to the entrance end of blades is chosen as a reference point when the entrance end of blades on the side edge located at the side of a suction pipe of the impeller blades is closer to the suction pipe than the discharge end thereof along the impeller axis, the length from said reference point to the upstream point of the by-pass unit for controlling the prerotation of flow is defined by $Z_1$, and the length from said reference point to the downstream point thereof is by $Z_2$, the positional relation between the by-pass unit for controlling the prerotation of flow and the impeller should fulfil following equations;

$$Z_1 \leqq 2 \cdot d_{MAX} + \Sigma B_i \text{ and}$$

$$0.03 \cdot d_{MIN} \leqq Z_2 < Z_1,$$

besides, in the case of $d_{MAX}$>100 mm and $d_{MIN}$>100 mm $$0.4 \cdot d_{MIN} < Z_1 - Z_2,$$

and in the case of $d_{MAX} \leqq 100$ mm and/or in the case of $d_{MAX}$>100 mm and $d_{MIN} \leqq 100$ mm $$40 \text{ mm} < Z_1 - Z_2.$$

5. By-pass unit for the controlling the prerotation of flow in a suction pipe of a fan according to claim 4, characterized by that said reference point is assigned to the point ($Z_{Pb}$) on the impeller axis corresponding to the discharge end of blade instead of the reference point described in claim 4 in the case that the discharge end of blades on the side edge located at the side of a suction pipe of the blades is closer to the suction pipe than the entrance end thereof along the impeller axis.

6. By-pass unit for the controlling the prerotation of flow in a suction pipe of a fan according to claim 4, characterized by that said reference point is assigned to the point ($Z_{Pc}$) on the impeller axis corresponding to the most upstream point of the mouth ring instead of the reference point described in claim 4 in the case that a mouth ring is attached to the side plate which is fixed to the blades on the side of suction pipe.

7. By-pass unit for the controlling the prerotation of flow in a suction pipe of a fan according to claim 4, characterized by that said reference point of an axial flow fan is assigned to the point ($Z_{Pd}$) on the impeller axis corresponding to the root of blades instead of the reference point of the centrifugal flow fan described in claim 4 in the case that the root of the upstream edge of the blades is closer to the suction pipe than the tip thereof along the impeller axis.

8. By-pass unit for the controlling the prerotation of flow in a suction pipe of a fan according to claim 4, characterized by that said reference point of an axial flow fan is assigned to the point ($Z_{Pe}$) on the impeller axis corresponding to the tip of blades instead of the reference point of the centrifugal flow fan described in claim 4 in the case that the tip of the upstream edge of blade is closer to the suction pipe than the root thereof along the impeller axis.

9. By-pass unit for the controlling the prerotation of flow in a suction pipe of a fan according to claim 4, characterized by that said reference point of a mixed flow fan is assigned to the point ($Z_{Pf}$) on the impeller axis corresponding to the tip of blades instead of the reference point of the centrifugal flow fan described in claim 4 in the case that no side plate is provided at the tip of impeller blade and the tip of the upstream edge of blade is closer to the suction pipe than the root thereof along the impeller axis.

10. By-pass unit for the controlling the prerotation of flow in a suction pipe of a fan according to claim 4, characterized by that said reference point of a mixed flow fan is assigned to the point ($Z_{Pg}$) on the impeller axis corresponding to the root of the upstream edge of blade instead of the reference point of the centrifugal flow fan described in claim 4 in the case that no side plate is provided at the tip of impeller blade and the root of the upstream edge of blade is closer to the suction pipe than the tip thereof along the impeller axis.

11. By-pass unit for the controlling the prerotation of flow in a suction pipe of a fan according to claim 4, characterized by that said reference point of a mixed flow fan is assigned to the point ($Z_{Ph}$) on the impeller axis corresponding to the most upstream point of the mouth ring instead of the reference point of the centrifugal flow fan described in claim 4 in the case that a mouth ring is attached the side plate which is fixed to the edge of the impeller blades.

* * * * *